US005597332A

United States Patent [19]

Walbrecht

[11] Patent Number: 5,597,332

[45] Date of Patent: Jan. 28, 1997

[54] SOLDER CONTACT

[75] Inventor: Wolfram Walbrecht, Wuppertal, Germany

[73] Assignee: Grote & Hartmann GmbH & Co. KG, Wuppertal, Germany

[21] Appl. No.: 286,704

[22] Filed: Aug. 5, 1994

[30] Foreign Application Priority Data

Aug. 6, 1993 [DE] Germany ..... 43 26 456.5

[51] Int. Cl.[6] ..... H01R 13/11

[52] U.S. Cl. ..... 439/850

[58] Field of Search ..... 439/78, 80–83, 439/817, 876, 853, 850

[56] References Cited

U.S. PATENT DOCUMENTS

| | | | |
|---|---|---|---|
| 4,012,107 | 3/1977 | Cobaugh et al. | 439/82 |
| 4,080,037 | 3/1978 | Kunkle et al. | 439/853 |
| 4,548,447 | 11/1985 | Dinsmore | 439/83 |
| 4,664,458 | 5/1987 | Worth | 439/82 |
| 4,892,492 | 1/1990 | Mueller | 439/78 |
| 4,904,192 | 2/1990 | Holden et al. | 439/78 |
| 5,035,650 | 7/1991 | Defibaugh et al. | 439/609 |
| 5,064,379 | 11/1991 | Ryll et al. | 439/81 |
| 5,201,663 | 4/1993 | Kikuchi et al. | 439/83 |
| 5,266,038 | 11/1993 | Nakamura | 439/79 |

FOREIGN PATENT DOCUMENTS

| | | | |
|---|---|---|---|
| 2652227 | 3/1991 | France | 439/83 |
| GM7638508 | 4/1977 | Germany . | |
| 3414323A1 | 10/1985 | Germany . | |
| 3613675 | 10/1987 | Germany | 439/83 |
| 3729546A1 | 3/1988 | Germany . | |
| 3633799A1 | 4/1988 | Germany . | |
| 3922237 | 1/1991 | Germany | 439/83 |
| 9001340 U1 | 7/1991 | Germany . | |
| 9105408 U1 | 8/1991 | Germany . | |
| 4109519A1 | 9/1992 | Germany . | |
| 4103423C2 | 4/1993 | Germany . | |
| 2108332 | 5/1983 | United Kingdom | 439/83 |

*Primary Examiner*—P. Austin Bradley
*Assistant Examiner*—Jill Demello
*Attorney, Agent, or Firm*—Jones & Askew

[57] ABSTRACT

A solder contact made of a stamped piece of sheet metal with a housing with housing walls and with a movably attached contact position bounded by two contact spring arms for contact with the contact pin, whereby the housing exhibits at least one soldering post insertable through a hole in a printed-circuit board and whereby the contact position bounding the contact spring arms with a bow spring arm support are connected to one of the housing walls and the bow spring arm support extends freely in the housing in an arched shape, so that the contact position bounded by the contact spring arms is arranged to be movable in the direction of the plug axis of and/or perpendicular to it.

19 Claims, 6 Drawing Sheets

SOLDER CONTACT

Figure 1:
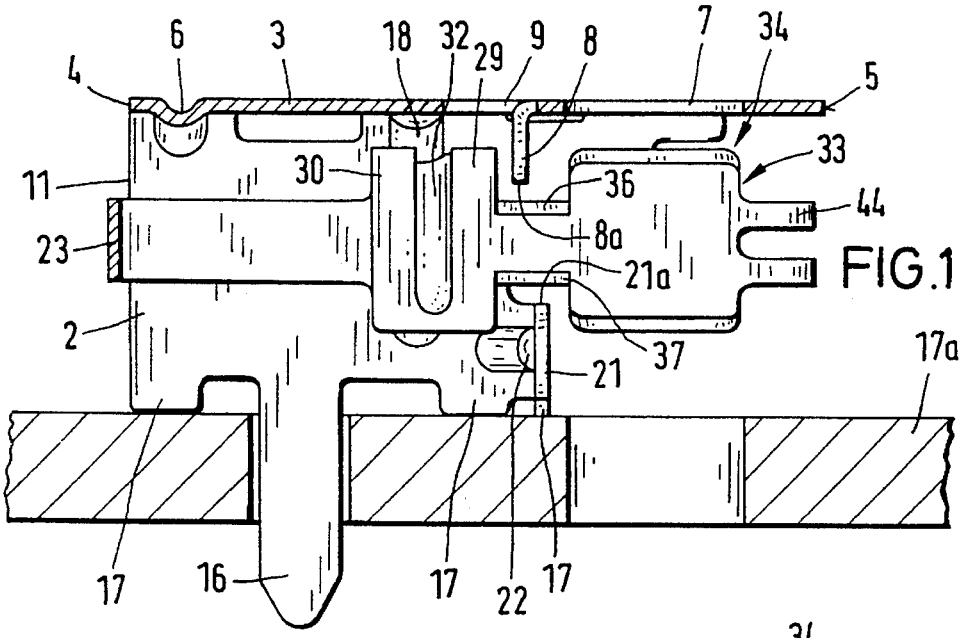

The invention concerns a single piece solder contact made of a punched piece of metal.

Such a solder contact is known from German Patent No. 4,103,423 C2. The contact position is arranged in this contact so that it is continually mobile, so that relative movements between the contact pin and the contact position of the solder contact can be prevented, while the contact position is especially movable in the plug axis direction and perpendicular to it, and thus it can follow the movements of a contact pin or the solder contact soldered to a printed-circuit board assembly.

The known solder contact is of relatively large volume on account of the special swingable mounting.

A similar solder contact is known from German Patent No. 4,109,519 A1; it has a basically cuboid form, with the contact areas provided perpendicularly centered at two opposite side surfaces; [these contact areas] are respectively connected to the front edges of the cuboid contact via meandering strips. Here, the contact position is arranged at the center of the cuboid solder contact and is provided with a fixed elasticity in the direction of the side walls. The path of a contact pin inserted into such a solder contact is thus limited by the front edges of the solder contact and they both are movable through the contact areas that have the meandering strips, each independently of the other, so that there is no contact position here with an exactly defined distance.

The problem of the invention is to create a solder contact with small space requirements, which has a movable contact position.

Due to the fact that the contact spring arms forming the contact position are connected to a bow spring arm support that extends from a housing wall across an arch, a relatively long bow spring arm support can be provided in a small housing, so that the desired mobility of the contact position is achieved, which makes it possible for a contact pin that is plugged into a contact position to move independently of the housing of the solder contact. Here, a release of the solder contact of a housing soldered to a printed-circuit board due to vibrations of a contact pin that is plugged into the contact position is eliminated, when only small movement forces are transferred by the contact pin through the contact position to the housing of the solder contact soldered onto a printed-circuit board.

Figure 2:
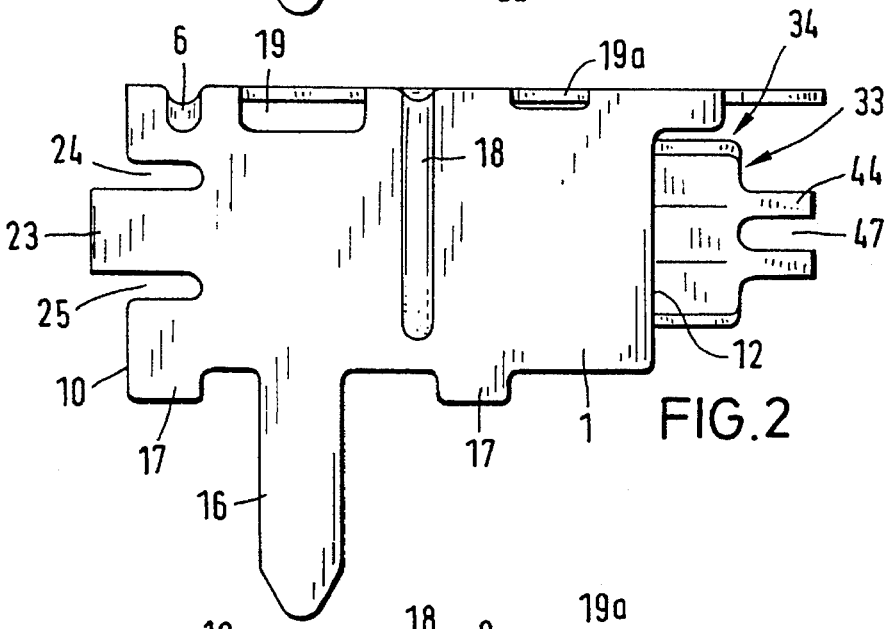
Figure 3:
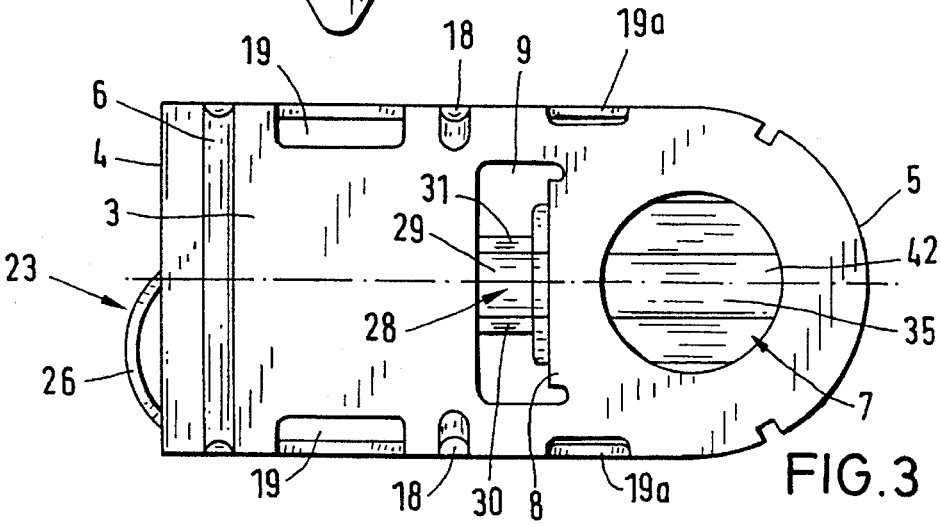
Figure 4:
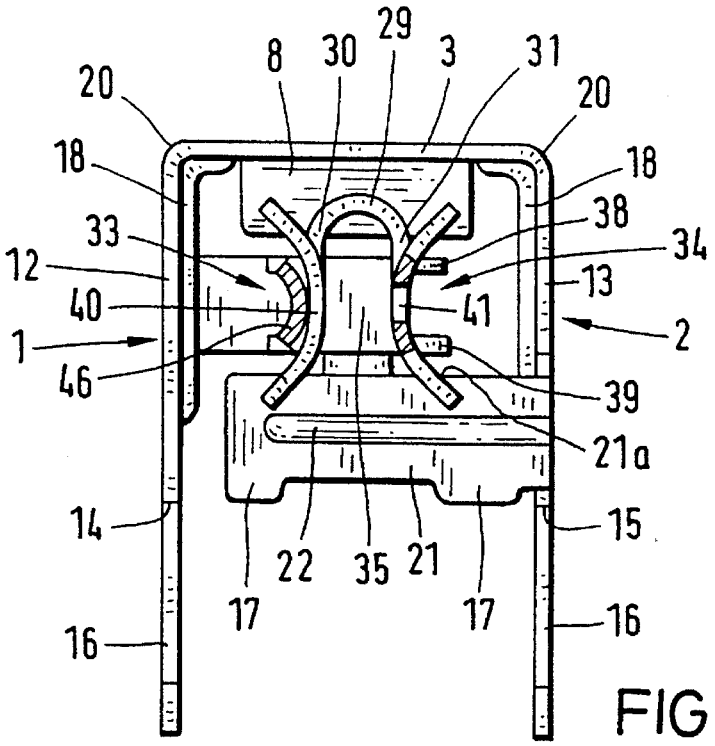
Figure 5:
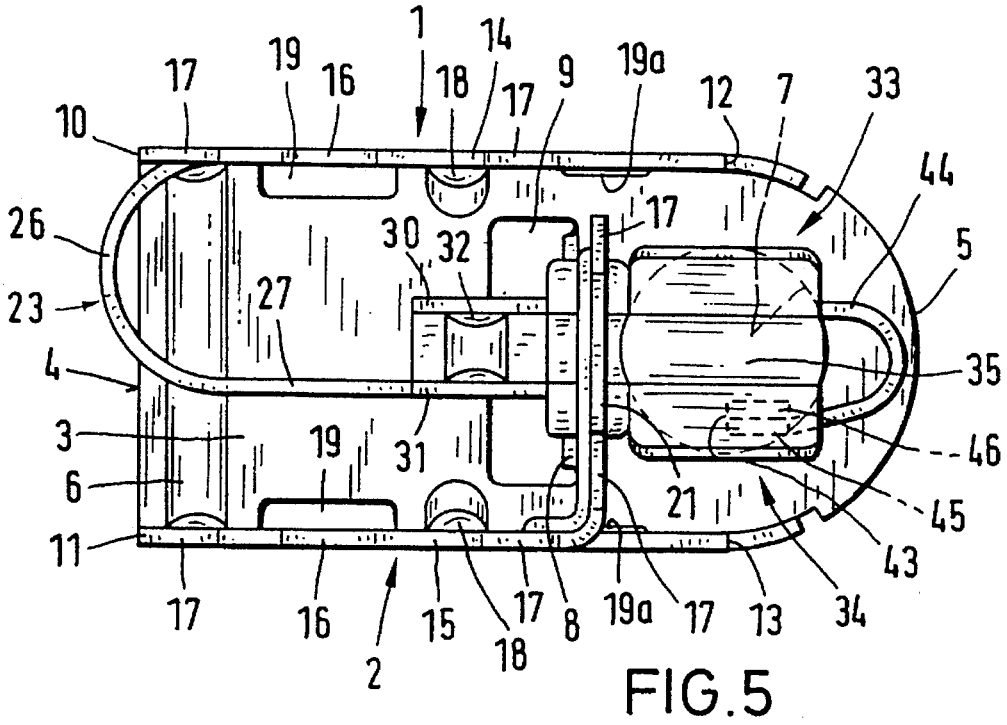
Figure 6:
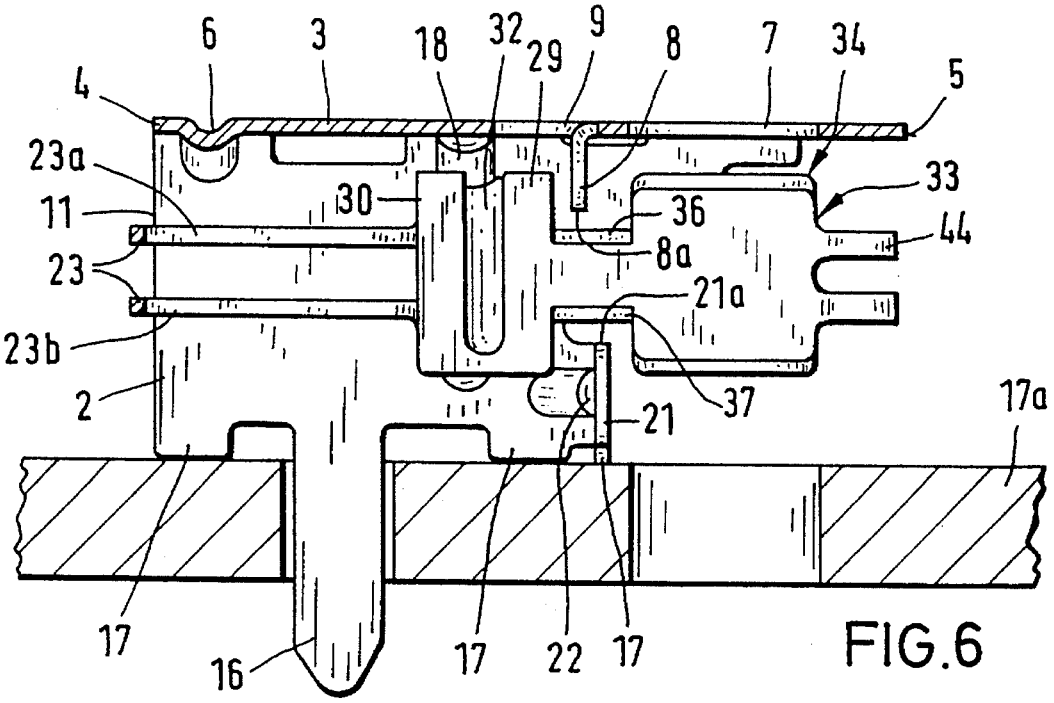
Figure 7:
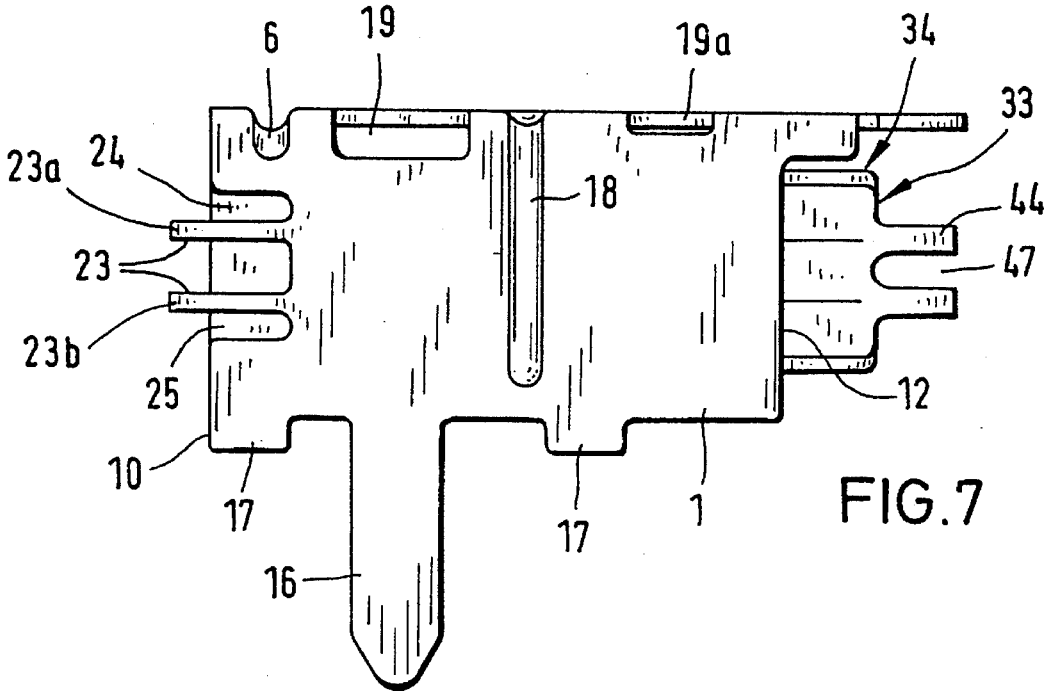
Figure 8:
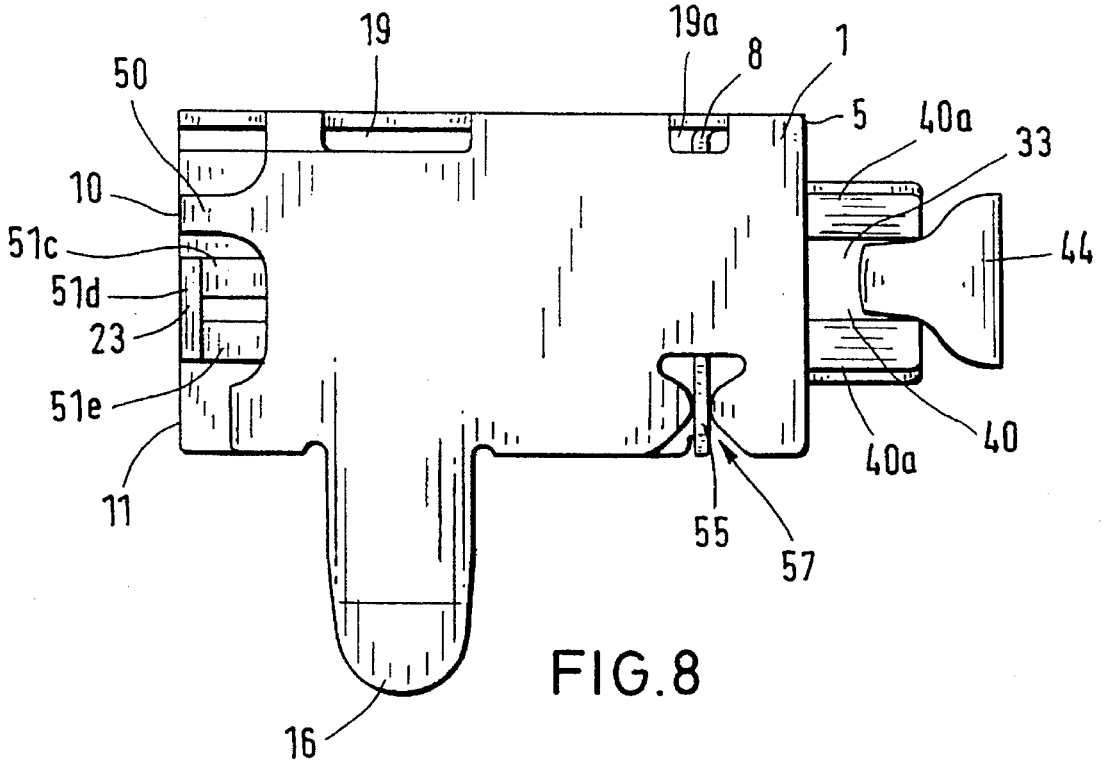
Figure 9:
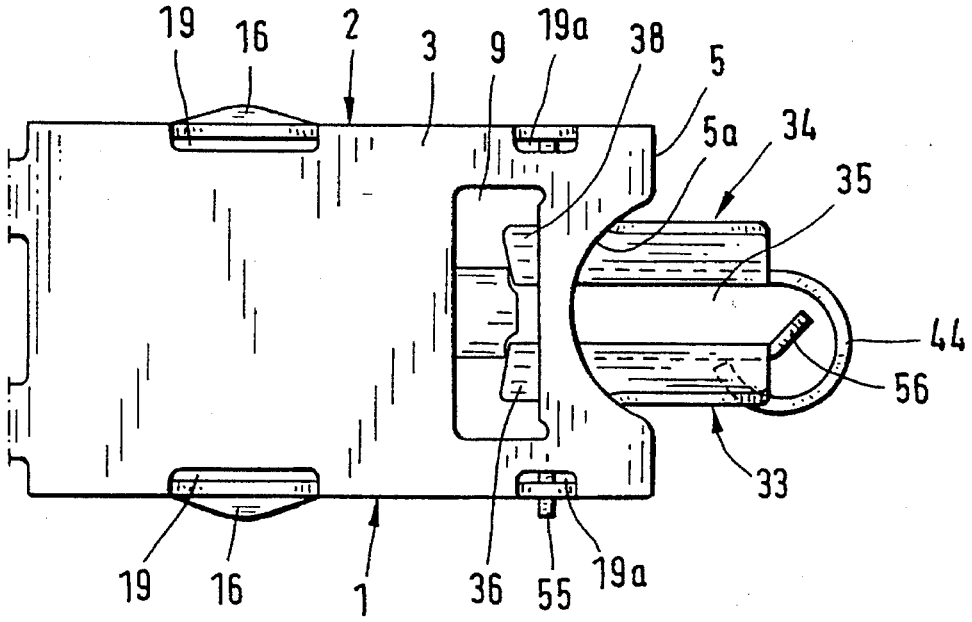
Figure 10:
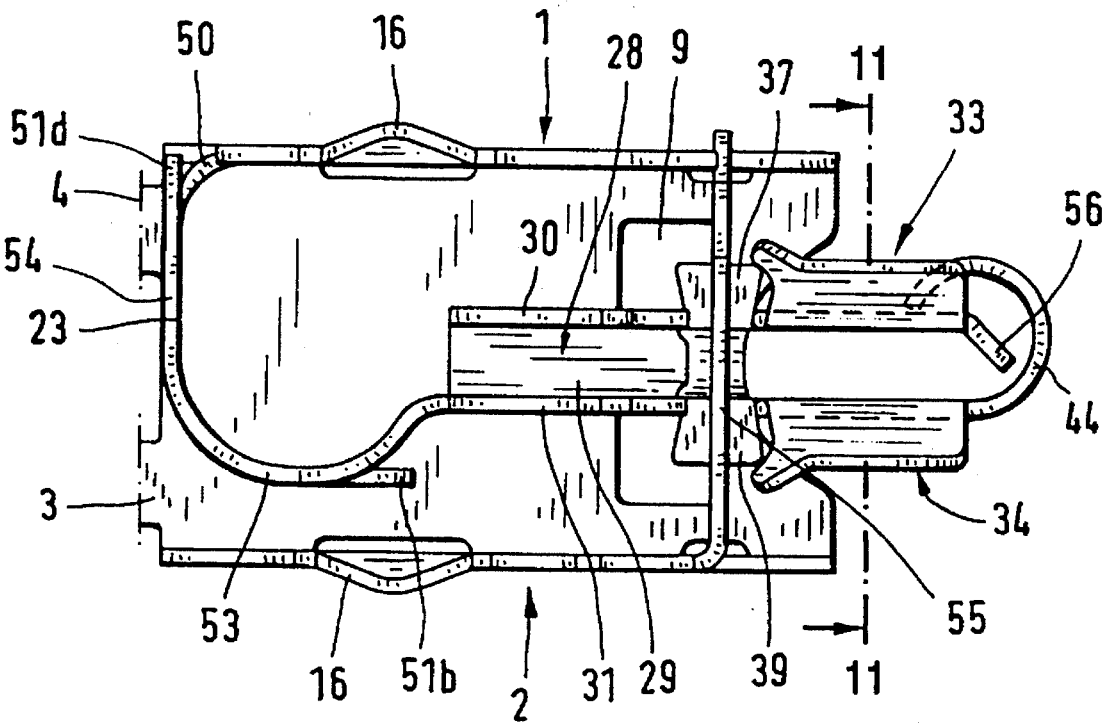
Figure 11:
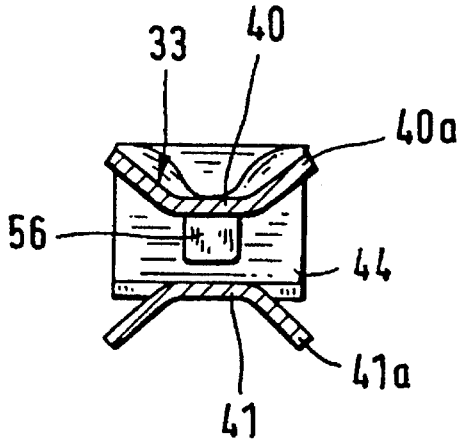
Figure 12:
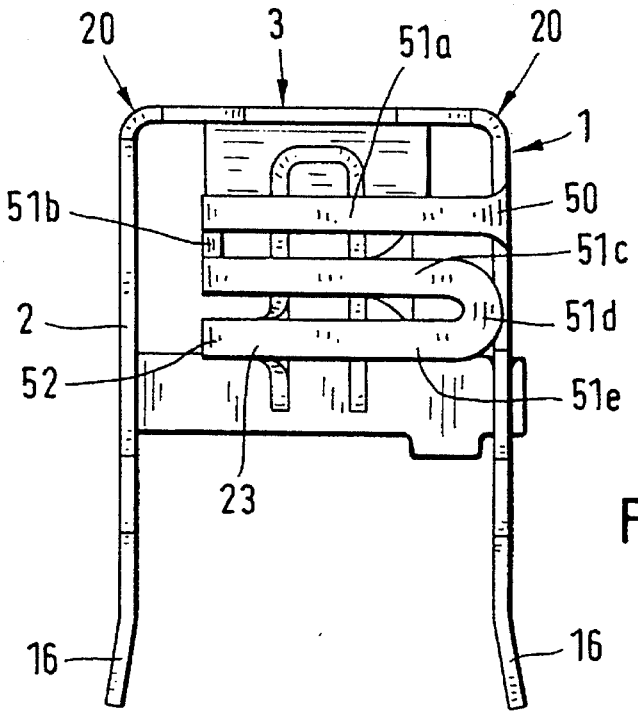
Figure 13:
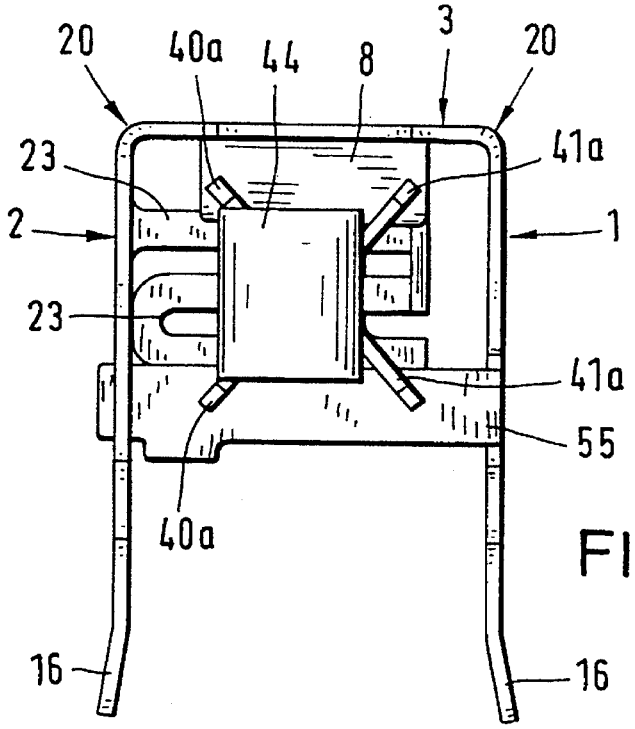

On the basis of the drawing, the invention is more exactly explained in the following by means of examples. The figures show:

FIG. 1: a side view of an embodiment of a solder contact according to the invention with the side wall cut away;

FIG. 2: a side view of the solder contact from FIG. 1;

FIG. 3: a plan view of the solder contact from FIG. 1;

FIG. 4: a front view of the solder contact from FIG. 1;

FIG. 5: a bottom view of the solder contact from FIG. 1;

FIG. 6: a side view of a second embodiment of the solder contact according to the invention with the side wall cut away;

FIG. 7: a side view of the solder contact from FIG. 6;

FIG. 8: a side view of a third embodiment of a solder contact according to the invention;

FIG. 9: a plan view of the solder contact from FIG. 9;

FIG. 10: a bottom view of the solder contact from FIG. 8;

FIG. 11: spring arm forming a contact position, in cross-section along line A—A of FIG. 10;

FIG. 12: a front view of the solder contact from FIG. 8 showing the side of the solder contact to which the bow spring arm support is connected; and FIG. 13: a front side of the solder contact from FIG. 8, which shows the side of the contact position of the solder contact.

A first embodiment of a solder contact according to the invention comprises two side walls 1 and 2 as well as a covering wall 3 (FIGS. 1–5). The side walls 1 and 2 are at right angles to the covering wall 3, so that a housing of a type that is open from below and has a U-shaped cross section is formed.

The covering wall 3 exhibits a free back edge 4, which proceeds linearly, and a free leading edge 5, which proceeds as a semicircle. Shortly before the back edge 4, a bead 6 running parallel to the back edge 4 is pressed into the covering wall 3, and extends over the side walls 1 and 2, so that the U shape of the housing is kept from widening by the bead 6. In the area of the leading edge 5, a plug hole 7, which is about 1.5 mm in diameter, is punched out in the covering wall 3 so that a plug contact pin (not illustrated) of about 1 mm thickness can be passed through. Between the plug hole 7 and the bead 6 in the covering wall 3, a catch tab 8 can be passed through a U-shaped free punch 9 indicating the hole 7; it is folded at a right angle toward the inside of the housing.

The side walls 1,2 exhibit free linear back edges 10,11, linear leading edges 12,13, as well as free linear lower edges 14,15. At each lower edge 14,15, a soldering post 16 is connected that extends from the edge; moreover, it is a short distance from the back edge 10 or 11. A short distance from each soldering post 16, an overhanging support tab 17 for supporting the housing is connected to a printed-circuit board 17*a*, whose function will be explained further below.

Each side wall 1,2 can exhibit a bead 18 running parallel to the back edges 10,11 in the area between the soldering post 16 and the leading edge 12 or 13 in order to brace it; this extends in each case somewhat into the covering wall 3. Among other things, to simplify the bending of the shape of the housing during manufacture of the solder contact out of a plate punched out of sheet metal, holes 19,19*a* are punched out at the longitudinal edges 20 in the transfer area between the side walls 1,2 and the covering wall 3, and suitably in the area between the beads 6 and 18, as well as between the bead 18 and the front edge 12 or 13. The side wall 2 exhibits an additional catch tab 21, which is formed from an indentation built in running parallel to the lower edge 15 at a distance from it, running from the leading edge 13 to here, whereby the catch tab 21 is turned at a right angle in the housing in such a way that it finds its free longitudinal edge 21*a*, which points toward the covering wall 3, at a distance under the free longitudinal edge 8*a* of the catch tab 8.

The function of the catch tabs 8,21 is explained further below. In the catch tab 21, a support bead 22 passes through the bending and is pressed into the longitudinal extension of the tab; in addition, it exhibits further lateral support tabs 17 for supporting the catch tabs 21 on the printed-circuit board 17*a*. In the direction of the central longitudinal axis of the housing, the catch tabs 8 and 21 are set very close to each other, whereby the catch tabs 8 are closer to the back edges 10,11 and the catch tabs 21 come to lie close to the leading edges 12,13. The function of the relative load of the catch tabs 8,21 is more closely and extensively explained below.

The side wall 1 exhibits a right-angled bow spring arm support 23, which is formed from two indentations 24 and 25 built into the back edge 10 of this side wall and runs approximately centrally between the covering wall 3 and the free lower edge 14 of the side wall 1. Issuing from its connection area at the side wall 1, the bow spring arm support 23 proceeds to bend in a semicircle, and this arched area 26 extends over the back edge 4 of the covering wall 3 slightly to the outside. At the end of the arched area 26, the bow spring arm support 23 runs parallel to the side walls 1 and 2 at a distance from them in an intersecting plane perpendicular to the ceiling wall 3 and closer to side wall 2. At the free end of the linear bow spring arm support area 27, a U-shaped spring arm base 28 is attached, which exhibits a U-shaped base support 29, which bends outward to the covering wall 3, with a spring casing line proceeding in the longitudinal direction of the housing and two straight U posts 30 and 31, which proceed parallel to the side wall 1,2; these project on both sides over the longitudinal edges of the straight bow spring arm area 27, and from this area, the post 31 lies in the elongation of the straight bow spring arm area 27. The spring arm base 28, on account of the eccentric load of the straight bow spring arm area 27, is separated from the side walls 1,2 by the same distance, and lies with its front edge separated from the catch tabs 8,21. In the U posts 30,31 and the U base support 29, an intersecting U-shaped bead 32 is pressed in, through which the spring arm base 28 is kept from expanding.

At the leading edge 5 of the covering wall 3, indicating the front edges of the two U posts 30 and 31, contact spring arms 33 and 34 are connected in one piece, which locate a contact position 35 under the plug hole 7. Catch tabs 36–39 are arranged perpendicular to the longitudinal extension, bending away from the spring arms 33,34, running through indentations that are parallel to one another in the connection area of the contact spring arms 33,34 at the U posts 30,31; these tabs cooperate with the catch edges 8*a* and 21*a*. The spring arm catch tabs 36–39 are bent outward by 90_ from the spring arms 33,34 and are separated by their free perpendicular edges from the catch edges 8*a*, 21*a*, so that the spring arms 33,34 extend freely throughout the narrowing that is located through the catch tabs 8 and 21, which lie opposite one another. The indentations that locate the catch tabs 36–39 are separated from one another in the longitudinal direction of the spring arm 33,34 in such a way that the spring arm catch tabs 36–39 also exhibit a distance from the catch tabs 8,21 in this direction. The catch tab 8 lies closer to the free front edges of the U posts 30,31 that are indented than does the tab 21, which, for its part, lies closer to the back edge of the contact areas 40,41 of the spring arm on the side of the contact position, positioned by the indentations, than does tab 8. The mobility of the bow spring arm support 23 is limited from above and below by the distance from the catch edges 8*a*, 21*a* to the catch tabs 36–39. The mobility of the bow spring arm support can be limited laterally by the side wall 1,2 or by a catch of the back edge of the contact sections 40,41 at the catch tab 21.

The contact position 35 is located by the contact areas 40 and 41 of the contact spring arms 33,34, which connect to the catch tabs 36–39 and stretch over the plug hole 7. The contact areas 40 and 41 are bent away around the central longitudinal axis of the housing on both sides of this axis to be perpendicular toward the outside on the side walls 1,2. Through this bending, the contact areas 40,41 are braced, and additionally, they form a location funnel 42 that lies opposite the plug hole 7 and expands up to this point. The curved contact sections 40,41 lie perpendicular to its arched casing lines, which are parallel to the central longitudinal axis, with a minimal distance opposite this, and so form the contact position 35.

A right-angled bow spring support 44 is connected to the front edge of the contact area 40; it is narrower than the contact area 40, it encompasses the other contact area 41 laterally from the outside with its free end 45, and with its free front edge 43, it lies in a plane that intersects the center of the plug hole. The section 46 with which the bow spring support 44 lies near the outer side of the contact area 41 is bent out slightly convex or partially cylindrically on the contact area 41 with arched casing lines running in the longitudinal direction and forms an abutment that presses the level of the contact position 35 outside against the contact area 41. By means of the bow spring support 44 developed in this way, which is connected to the one contact area 40 in one piece and presses outward against the other contact area 41, during introduction of the plug contact pin into the contact position 35 by means of the plug hole 7, this pin is held firmly in the contact area. The weak spring characteristics of the bow spring support 44 are determined through a slot 47, which stretches from its connection area at the contact area 40 up to its convex installation area 45. The bow spring support 44 stretches close to the leading edge 5 of the covering wall 3. A permanent solid contact of the plug contact pin is achieved by means of the bow spring support 44.

The bow spring arm support 23 is likewise characterized by weak spring characteristics, which is a result of its great length and due to which it is achieved that the contact position 35 that firmly holds the contact pin is permanently movable, so that relative movements between the contact pin and the contact position are prevented, while the contact position 35, in particular, is movable in the plug axis direction, as well as perpendicular to it, so that the contact position 35 can follow the movements of the contact pin, which occur in the range of the freedom of movement of the spring arms 33,34 in the area of its catch tabs 36–39 opposite the catch tabs 8,21 fastened to the housing. According to the invention, the particular swingable mounting of the contact position 35 is reached with a small volume of the solder contact because of the long bow spring arm support 23, which, as an alternative to the projecting embodiment described, may also be lengthened due to the fact that its connection area again is embedded in the side wall 1 through correspondingly deep indentations.

A second embodiment of the invention (FIGS. 6 and 7) has a bow spring arm support 23, which is formed from two thin arched slides 23*a*, 23*b*. Through these two thin arched slides 23*a*, 23*b*, the elasticity and consequently the mobility of the contact position defined by the contact spring arms 33,34 are essentially increased opposite the first embodiment with a strip-like bow spring arm support 23. This mobility of the contact position 35 makes it possible for a contact pin located in the contact position 35 to be still more freely movable opposite the housing of the solder contact; in particular, it can swing or vibrate, whereby the electrical contact is not interrupted and the movement energy of the contact plug pin is not transferred (or only to a very negligible part) to the housing, so that the solder contact is permanently fastened firmly on the printed-circuit board 17*a*.

Through the development of the bow spring arm support 23 from two thin arched slides 23*a*, 23*b*, the arched area 26 can be bent with a smaller radius, so that during connection of the arched slides with indentations 24 and 25 they do not project outward over the back edge 4 of the covering wall 3. Thus a lateral protection of the arched slides 23*a*, 23*b* is guaranteed, and the total length of the solder contact is further diminished. In other respects, the second embodiment of the invention (FIGS. 6 and 7) is identical to the first embodiment (FIGS. 1–5), so identical parts of the solder contacts are identified by the same reference numerals.

A third embodiment of the invention (FIGS. 8–13) has a meandering spring arm support 23 (FIG. 12). The spring arm support 23 is connected to an arched area 50 on the side wall 1. The arched area 50 of the bow spring arm support 23 changes into a meandering twisting area with straight line areas 51*a*, 51*c*, and 51*e* of the bow spring arm support 23, which are each connected through narrow arcs 51*b* and 51*d* to one another. This meandering twisting area of the bow spring arm support 23 extends from the area of connection 50 at the side wall 1 back in the direction toward the back edge 4, whereby the bow spring arm support transforms into a linear area 54 running perpendicular to the side wall 1; at this area another arched area 53 is connected, which runs approximately in the center of the housing of the solder contact, where the U-shaped spring arm base 28 is connected to the bow spring arm support 23 (FIG. 10). Between the bow spring arm support 23 and the side wall 2, there is a free space, in which the meandering bow spring arm support 23 can elastically deform. The bow spring arm support 23 that runs in a meandering form like this, lies completely within the area that is bound by the side walls 1,2 and the covering wall 3. That is, the bow spring arm support 23 does not extend past the back edge 4 of the covering wall 3 to the outside, as is the case in the first embodiment. The meandering area of the bow spring 23, which advantageously extends from the area of the connection 50 into the arched area 53, provides the bow spring arm support 23 with weak spring characteristics, so that the contact spring position 35, bound by the two contact spring arms 33,34 is almost freely movable with reference to the housing of the solder contact, but without the electrical connection, which runs from the contact spring arms 33,34 over the spring arm base 28 to the bow spring arm support 23, the housing with the side walls 1,2 and the covering wall 3, and the soldering posts 16, are interrupted.

By means of indentations extending parallel to each other in the connection area of the contact spring arms 33,34 at the U posts 30,31, catch tabs 36–39 are formed, which bend outward perpendicular to the longitudinal direction of the contact spring arms 33,34. These catch tabs 36–39 cooperate with a tab 8 through a free punch 9 that is punched out of the covering wall 3; this tab limits the movement of the contact spring arms 33,34 in the direction of the coveting wall 3, and further cooperates with a brace 55, which is connected to the side wall 2 and extends from the side wall 2 to the side wall 1 at an approximately right angle to the side walls 1,2, through which the movement of the contact spring arms 33,34 is limited in the direction away from the covering wall 3. The brace 55 advantageously lies in an indentation 57 in the side wall 1, so that its position is fixed, which is not transferred to the tab 8 in the longitudinal direction of the solder contact in this embodiment. The tab 8 and the brace 55 are arranged at a distance from the respective catch tabs 36–39, so that the contact spring arms 33,34 have play up and down. The covering wall 3 does not extend over the contact position 35, but rather has a leading edge 5 with an arched area 5*a*, over which the contact spring arms 33,34 project.

The contact spring arms 33,34 form contact areas 40,41 in their central areas; at these contact areas, tabs 40*a* and 41*a* are connected, in each case turned toward the outside, in order to form such a location funnel for a contact plug pin. The contact areas 40,41 are connected with a bow spring support 44 again, which is connected to the contact area 41 and presses outward against the other contact area 40. At contact area 40, another tab 56 is connected, which slants toward the front in the direction of the oppositely situated contact area 41, so that the contact position 35 is limited toward the front.

Due to the development of the bow spring arm support 23 from arched slides or of meandering bow spring arm support 23, the spring characteristics are clearly weaker compared with the first embodiment, so that the contact position can be moved almost completely independently of the housing of the solder contact and is only limited from above and below by the tabs 8,21 or the tab 8 and the brace 55, and laterally by the side walls 1,2, at which the tabs 40*a*, 41*a* of the contact spring arms 33,34 contact. Due to the weak spring characteristics, it is additionally necessary to strengthen the walls 1,2, and 3 of the housing by means of beads or a similar means, where the forces exerted by a contact plug pin on the walls via the contact spring arm are very slight. This simplifies the manufacturing process and thus minimizes the manufacturing costs of the solder contact.

I claim:

1. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the bow spring arm support (23) is formed from two thin arched slides (23*a*, 23*b*).

2. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the bow spring arm support (23) is formed to be meandering.

3. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the plug axis direction of the contact plug pin is perpendicular to a longitudinal direction of the solder contact.

4. The solder contact according to claim 3, characterized in that the plug axis direction of the contact pin extends parallel to a plug axis direction of the soldering post (16).

5. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein in the housing wall (1,2) to which the bow spring arm support (23) is connected, indentations (24,25) are introduced, through which the bow spring arm support (23) is lengthened.

6. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the bow spring arm support (23) extends from the housing wall (1,2) to which it is connected into a semicircular arch in the housing of the solder contact; and an area (27) of the bow spring arm support (23) proceeding linearly is connected to the semicircular arch, to which area a U-shaped spring arm base (28) is attached in one piece, comprising two linear U posts (30,31) to each of which a contact spring arm (33,34) is connected, whereby the spring arm base (28) is arranged between the bow spring arm support (23) and the contact spring arms (33,34).

7. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the mobility of the spring arms (33,34) or the contact position (35) is limited by catch tabs (8,21) fastened to the housing, which are each arranged opposite one another in a plug axis direction of a contact plug pin extending perpendicular to the spring arms (33,34).

8. The solder contact according to claim 7, characterized in that one of the catch tabs (8) is punched out through a U-shaped free punch in the covering wall (3) connecting the housing walls (1, 2) and is bent into the housing.

9. The solder contact according to claim 7, characterized in that the catch tab (21) fastened to the housing, is bent into the housing, and forms a right-angled tab.

10. The solder contact according to claim 9, characterized in that the brace (55) fastened to the housing extends from the housing wall from which it is punched free or out, up to the opposite housing wall (1,2) and intersects that opposite wall housing at indentation (57).

11. The solder contact according to claim 7, characterized in that the catch tabs (8,21) fastened to the housing are arranged in the direction of the longitudinal axis of the housing with respect to each other.

12. The solder contact according to claim 7, characterized in that the brace (55) fastened to the housing is bent into the housing and forms a right-angled tab.

13. The solder contact according to claim 7, characterized in that the catch tab (8) fastened to the housing and the brace (55) fastened to the housing are arranged in the direction of the longitudinal axis of the housing with respect to each other.

14. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the housing has a U-shaped cross section with a coveting wall (3) and two side walls (1,2) which are arranged opposite to each other and to which the soldering posts (16) are connected at free lower edges wherein the soldering posts (16) lie advantageously in planes of the side walls (1,2), with the bow spring arm support (23) being connected to a side wall (1,2).

15. The solder contact according to claim 14, characterized in that the covering wall (3) extends over the contact position (35) and exhibits a plug hole (7) for free passage of a contact plug pin.

16. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the contact spring arms (33,34) are formed from contact areas (40,41) that proceed perpendicular to a plug axis direction of a contact pin, to which areas tabs (**40*a*, 41*a***), which are turned in the plug axis direction toward an outside, so that they form a location funnel for the contact pin.

17. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein a bow spring support (44) is connected to one of the contact spring arms (33,34), which support extends from the side facing the spring arm base into an arch of a corresponding end of the opposite contact spring arm (33,

34), so that the bow spring support (44) engages the opposite contact spring arm laterally and lies close to the opposite contact spring arm outside in an area of a contact position (35).

18. Solder contact according to claim 17, characterized by the fact that the bow spring support (44) exhibits a slot (47) which basically extends over its entire length.

19. A solder contact made of a stamped piece of sheet metal with a housing with housing walls (1,2,3) and with a movably attached contact position (35) defined by two contact spring arms (33,34) for contact with a contact plug pin, whereby the housing comprises at least one soldering post (16) insertable through a hole in a printed-circuit board, characterized in that the contact spring arms (33,34) defining the contact position (35) are connected by a bow spring arm support (23) to one of the housing walls (1,2,3) and the bow spring arm support (23) extends freely in the housing in an arched shape, so that the contact position (35) defined by the contact spring arms (33,34) is elastically movable in a direction of a plug axis and perpendicular to said direction, and wherein the mobility of the spring arms (33,34) or the contact position (35) is limited by a catch tab (8) fastened to the housing and a brace (55) fastened to the housing, which are each arranged opposite one another in a plug axis direction of a contact plug pin extending perpendicular to the spring arms (33,34).

* * * * *